US005595007A

United States Patent [19]

Biance

[11] Patent Number: 5,595,007

[45] Date of Patent: Jan. 21, 1997

[54] TRAILER-TYPE SNOWPLOW

[76] Inventor: Michael P. Biance, 4 Ritannie Ct., Latham, N.Y. 12110

[21] Appl. No.: 346,093

[22] Filed: Nov. 29, 1994

[51] Int. Cl.[6] ..... E01H 5/06

[52] U.S. Cl. ..... 37/268; 37/232; 37/266; 37/274; 37/279; 172/820; 172/445.2

[58] Field of Search ..... 37/232, 266, 268, 37/271, 274, 279, 281, 283; 172/818, 820, 735, 219, 445.1, 799.5

[56] References Cited

U.S. PATENT DOCUMENTS

| | | | |
|---|---|---|---|
| 4,369,590 | 1/1983 | Miller | 37/271 X |
| 4,403,432 | 9/1983 | Biance . | |
| 4,754,562 | 7/1988 | McGarrah et al. | 37/283 X |
| 4,924,610 | 5/1990 | Sodemann | 37/266 X |
| 4,976,054 | 12/1990 | Jones | 37/283 |
| 5,050,322 | 9/1991 | Burkard | 37/266 X |
| 5,136,795 | 8/1992 | Rosenberg | 37/232 X |
| 5,285,588 | 2/1994 | Niemela et al. | 37/232 X |
| 5,400,859 | 3/1975 | Harrell | 172/204 X |
| 5,411,102 | 5/1995 | Nickels et al. | 37/268 X |

*Primary Examiner*—Randolph A. Reese
*Assistant Examiner*—Thomas A. Beach
*Attorney, Agent, or Firm*—Schmeiser, Olsen & Watts

[57] ABSTRACT

The invention is a trailer-type snowplow assembly. The assembly includes one pivot mechanism that allows the plow blade to be raised or lowered. The assembly further includes a free pivot assembly that allows the blade to freely pivot in a transverse direction in response to directional changes of the tow vehicle or uneven snow impact along its length. Also disclosed is a multi-piece plow blade that has removable end portions that allow a user to elongate or shorten the effective length of the plow blade.

14 Claims, 2 Drawing Sheets

TRAILER-TYPE SNOWPLOW

FIELD OF THE INVENTION

The invention is in the field of snow removal apparatus. More particularly, the invention is a snowplow designed to be secured to the rear of a vehicle and towed behind said vehicle. The snowplow includes apparatus that allows the plow blade to be raised and lowered. The snowplow also includes an automatic pivot mechanism that enables the plow blade to pivot without requiring manual manipulation by the operator.

BACKGROUND OF THE INVENTION

Vehicle-mounted snowplows are well known in the art and are in common use. These plows typically attach to the front bumper of a vehicle and are raised or lowered using a hydraulic lift mechanism. The angle of the plow blade relative to the vehicle's bumper is sometimes manually adjustable.

To install the typical snowplow, mounting brackets are initially affixed to the vehicle and thereafter the blade of the plow is fitted onto the brackets when the plow is to be used. To avoid having to repeat the time consuming installation process every time it snows, many people will leave the plow blade attached to the vehicle for extended periods. Even after the plow blade has been removed, the mounting brackets are usually left on the vehicle year-round.

In recent years, a trailer-type snow plow was invented (see U.S. Pat. No. 4,403,432 issued to Biance). The entire plow assembly is in the form of a single fixture that is designed to be connected to an existing rear-mounted receiver-type trailer hitch of the vehicle. The assembly can be quickly installed or removed and does not require the permanent installation of specialized brackets or other hardware on the vehicle. Once installed, the plow is towed behind the vehicle and can be raised or lowered using a manual or electric winch. The transverse angle of the plow blade (the angle of the blade relative to its direction of travel) may be changed using a manually-adjustable pivot mechanism.

During the plow blade installation process, the blade will normally be set at an angle relative to the front or rear of the vehicle. The blade must be set at an angle prior to plowing so that the snow will be pushed to the side during the plowing operation. For vehicles that have a fixed blade, the angle is set when the blade is mounted on the brackets. For vehicles that have an adjustable blade, the angle is set prior to the plowing operation and then it may be reset during the operation. Being able to vary the angle of the blade allows the operator to change the direction in which the snow is pushed. This greatly facilitates plowing around obstacles and allows greater flexibility when piling the snow about the area being plowed.

Certain problems still exist for users of prior art snowplows. The greatest problem involves the difficulty in changing the transverse or side-to-side angling of the plow blade prior to and during use to facilitate the plowing operation. Many operators avoid changing the angle of the blade since it may require the user to remove significant quantities of ice and snow from the area surrounding the pivot mechanism. In addition, the mechanism itself may become frozen due to icing of the pivot mechanism.

Therefore, changing the angle of the blade typically requires significant expenditures of time and effort. This is usually exacerbated by inclement weather at the time the user is employing the apparatus.

Another problem experienced by users of the prior art snow plowing apparatus is that the plow blade is usually inefficiently sized for the plowing conditions. A blade that is fairly small will cause the operator to have to make a larger number of traverses of the area to be plowed than would be required if a longer plow blade was being used. This problem is most noticeable when one wishes to use a small blade for plowing a driveway and a longer blade for plowing a parking area. In view of these considerations, the width of the plow blade may not be matched to the particular plowing operation.

It is therefore desirable to provide a plowing apparatus that does not succumb to the above-noted problems. The apparatus should include a plow blade that may be pivoted with little or no effort on the part of the user. The plow blade should also include a mechanism that enables a user to adjust the size of the blade to efficiently match the snow conditions. In addition, the apparatus must be capable of being rapidly deployed on or removed from a vehicle. It is furthermore desirable that the apparatus include a simple adjustment mechanism for the elevation of the plow blade.

SUMMARY OF THE INVENTION

The invention is a trailer-type snowplow apparatus that is designed to be pulled behind a vehicle. The apparatus includes a central member that has a front portion and a rear portion. The front portion is adapted for releasable attachment to the rear of a vehicle. The rear portion is connected to a multi-part plow blade.

The front and rear portions of the central member are connected to each other by a pivot assembly. This allows the rear portion to be pivoted in a vertical direction to thereby enable height adjustment of the plow blade. A winch is mounted atop the front portion of the central member and includes a strap that is connected to the member s rear portion to facilitate raising or lowering of the plow blade relative to the ground.

A non-rigid connection is employed between the plow blade and the rear portion of the central member. The connection allows the blade to freely pivot in a horizontal plane. This enables the operator to change the angle of the blade relative to the rear bumper of the vehicle without having to get out of the vehicle. The blade will automatically pivot in response to unequal forces applied along the length of the blade by the snow accumulating along the face of the blade as the vehicle travels. Once the plow blade has pivoted in response to a movement of the vehicle or uneven snow impact along its length, the plow will tend to remain in that position while the vehicle traverses a straight path or a path that is complementary to the angle of the plow. If the operator of the vehicle wishes to change the angle of the plow, the operator changes the direction of the vehicle accordingly or moves the vehicle so that the bulk of the snow will contact the opposite end of the plow blade. This can be accomplished with the vehicle proceeding in a forward or rearward direction.

In addition to the novel configuration of the basic plowing apparatus, the invention makes use of a multi-part plow blade. The plow blade includes a center portion and two removable end portions. The center portion is pivotally connected to the central member of the plowing apparatus as previously described. The outer portions of the blade are removably connected to the blade's center portion using a rod and sleeve arrangement. The multi-part blade allows a user to deploy an extended blade (all three parts connected) when plowing large areas. For plowing in restricted areas, the outer portions of the blade may be removed from the center portion of the blade thereby significantly reducing the width of the blade.

DETAILED DESCRIPTION OF THE INVENTION

Figure 1:
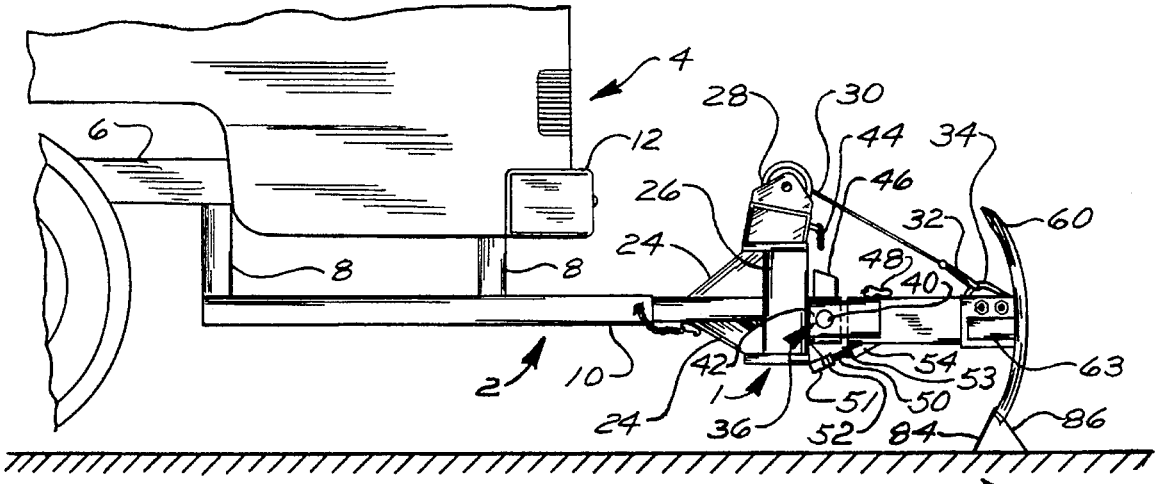
FIG. 1 is side view of a trailer-type snowplow in accordance with the invention and connected to the rear-located trailer hitch of a vehicle.

Referring now to the drawings in greater detail, wherein like reference characters refer to like parts throughout the several figures, there is shown by the numeral 1 a snowplow assembly in accordance with the invention attached to a receiver 2 located on the rear of a vehicle 4.

The receiver 2 is preferably a standard receiver-type heavy-duty trailer hitch. This type of hitch is commonly used for towing travel trailers and boat trailers. Alternatively, the receiver can be a structure designed specifically for attachment to the snowplow assembly. The receiver/hitch 2 is attached to the vehicle's frame 6 by vertically-oriented members 8 and includes a tubular receiver 10 located below the vehicle's rear bumper 12. Square steel tubing is typically used to form the different parts of the receiver/hitch.

The plow assembly 1 includes a tubular central member 14 made of a metal material such as steel. The member is made up of a front portion 16 and a rear portion 18. The front portion incorporates a tongue 20 adapted to be received within the receiver portion 10 of the receiver/hitch 2. A steel pin 22 is inserted through a hole in both the receiver portion 10 and the forward portion of the tongue to thereby releasably lock together said components. The pin will normally include locking structure such as a cotter pin (not shown) to releasably lock it in place.

The front portion 16 of the plow assembly's central member includes strengthening gussets 24 and a box-like pedestal member 26. The gussets and pedestal are manufactured from a high-strength material such as steel.

Located atop the pedestal member 26 is an electrically-operated winch 28. The winch includes a motor 29 and a strap 30 that is wound about the winch's central spool. The distal end of the strap includes a shackle 32 that is releasably secured to a metal hook 34 located on the rear portion 18 of the central member.

Connecting the front and rear portions of the central member is a pivot assembly 36. The assembly includes a central pin 40 that extends through complementary apertures in a 'U'-shaped clevis 42 that forms the front end of the central member's rear portion 18. The pivot assembly allows said rear portion to pivot in a vertically-oriented plane. This pivoting is normally achieved through operation of the winch whereby the length of the exposed strap 30 is increased or decreased. Safety chain 44 prevents inadvertent separation/downward pivoting of portion 16 from portion 18 when the safety chain is attached to chain retaining clip 48 on portion 18.

To limit the upward or downward range of motion of the rear portion of the central member, two limit stops are employed. The first stop is achieved using post member 46. The post member functions as a stop to any counterclockwise pivoting of portion 18. The second stop makes use of a threaded rod 50 that is received within a sleeve 51 secured to the bottom of the central member's front portion 16. The rod includes nuts 52 that may be rotated to change the exposed length of the rod. The outer end of the rod includes a cap 53 that can contact a shoulder member 54 attached to the bottom of the central member's rear portion. The two stops effectively limit the range of relative pivotal motion between the two portions of the central member.

Figure 2:
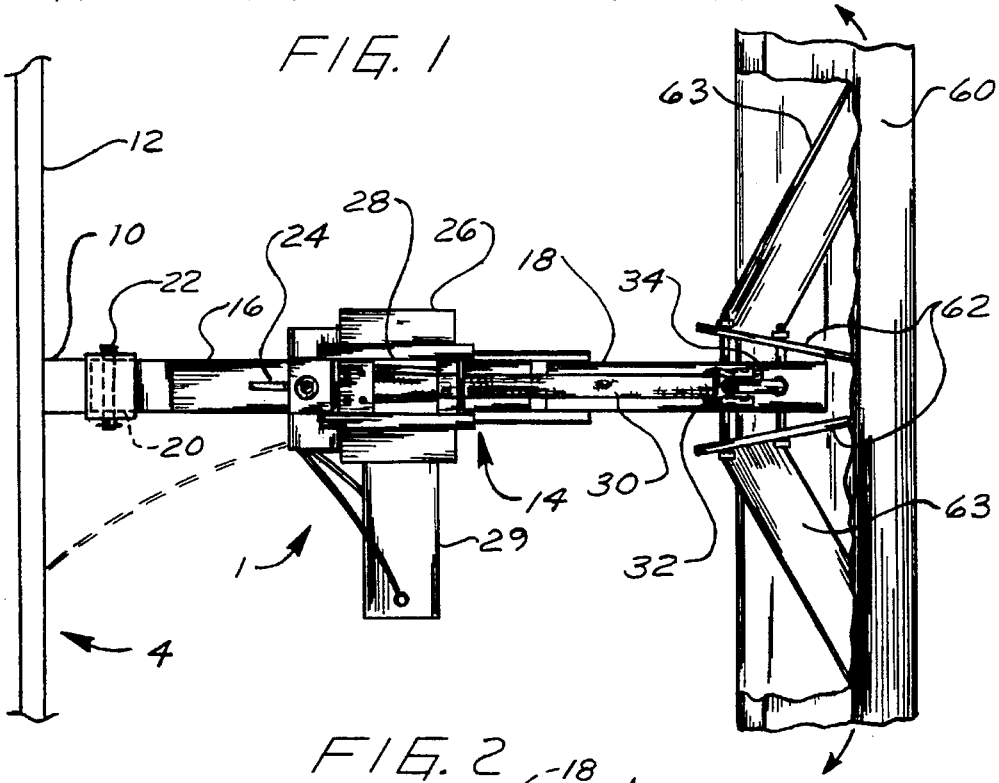
FIG. 2 is a plan view of the snowplow shown in FIG. 1 with the blade in partial cut-away.
Figure 3:
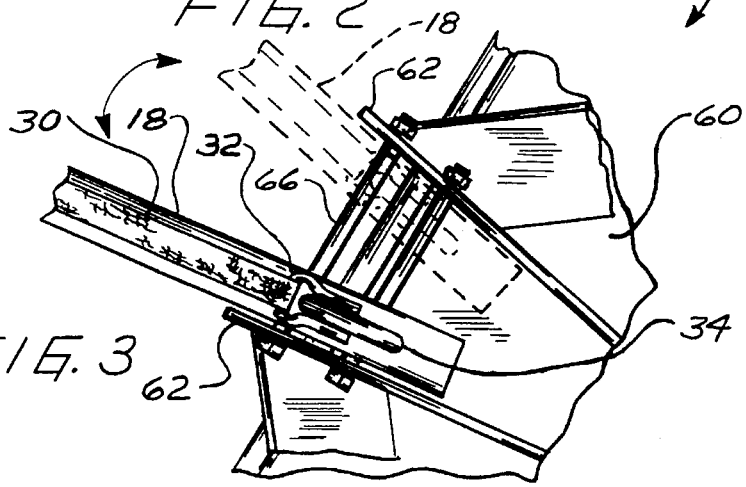
FIG. 3 is a detailed plan view of the connection of the plow blade to the rear portion of the central member of the snowplow shown in FIG. 1.
Figure 4:
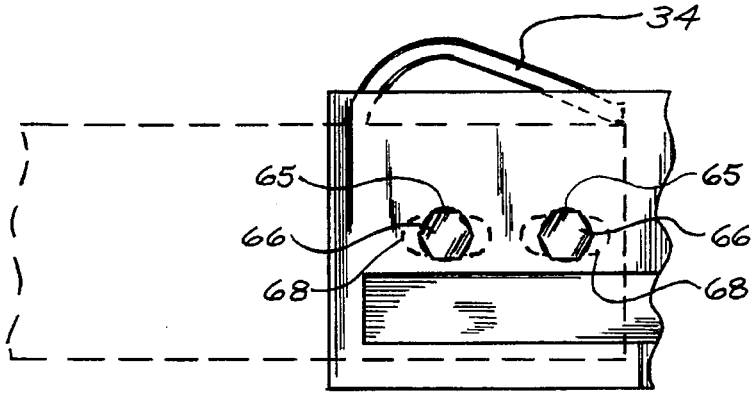
FIG. 4 is a detailed side view of the connection shown in FIG. 3.

FIGS. 2–4 provide detailed views of the pivotal connection between the plow blade 60 and the rear portion 18 of the central member. The blade includes two projecting metal fins 62 that are non-parallel and form a truncated 'V'-shaped clevis. The attachment between the fins and the blade is further reinforced by metal support members 63 that extend from the front face 64 of the blade to the side of each fin. The support members also function to spread out the load forces at the connection between the blade and the rear portion of the central member 14.

Each fin 62 includes two spaced apertures 65. Two fasteners 66, each in the form of a threaded bolt and complementary nut, pass through the apertures and extend from one fin to the other. The bolt portion of the fasteners also extends completely through the portion of the central member that is located between the fins 62 (note FIGS. 2–4). The central member includes elongated slots 68 (note FIG. 4) that receive the bolts. Each slot has a height that is slightly larger than the bolt that passes through it. However, the width of the slot is approximately two to four times the diameter of the bolt. In this manner, the slots 68 allow the bolts to slide in a forward or rearward direction within portion 18 and also to pass through portion 18 in a diagonal direction (note FIG. 3). Therefore, the play between the bolts and slots 68 enable a pivot action between the blade and portion 18 of the central member.

In FIG. 3, the pivot arrangement is shown with the blade positioned at approximately a thirty degree angle to the longitudinal axis of the vehicle's rear bumper 12. In this position, the bolt portion of each fastener 66 has moved to the extreme ends of the slots 68 (i.e.—one end of each bolt is located at the extreme forward end of one of the slots 68 that it passes through while the other end of the bolt is located at the extreme rearward end of the other slot 68 that it passes through). In FIGS. 2 and 4, one can see the arrangement of this connection when the blade is positioned substantially parallel to the vehicle's rear bumper and the bolts are perpendicular to the longitudinal axis of member 14.

The plow blade 60 has an arcuately-shaped front surface 64 as is typical for blades designed for plowing snow. The arcuate shape of the blade's surface is designed to facilitate the flow of the displaced snow along the blade. Alternatively, a blade having a flat front surface may be employed.

Figure 5:
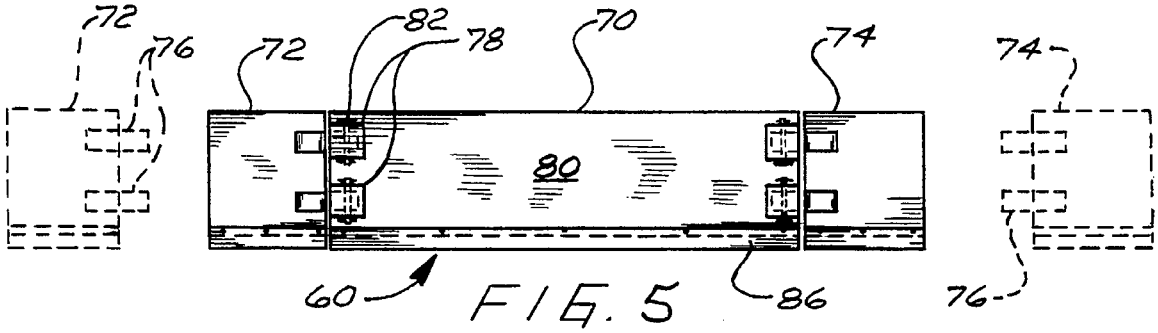
FIG. 5 is a rear view of the blade of the snowplow shown in FIG. 1. In this view, the outer sections of the blade are shown in solid in an attached position and in phantom in a released position.

FIG. 5 provides a detailed rear view of the plow blade 60. Blade 60 is preferably made of metal and is approximately two feet high, six to twelve feet long and one-quarter inch thick. The blade includes a four to eight feet long primary portion 70 to which the fins 62 are secured. The blade further includes two removable end portions 72 and 74 that are each one to two feet long.

FIG. 5 also shows, in phantom, the end portions removed from center portion 70. Each end portion 72 and 74 includes two tubular, horizontally-oriented lugs 76 that can be removably inserted into complementary housings 78 located on the rear surface 80 of the primary portion. The lugs are releasably locked to the housings using cotter pins 82 or other conventional fastening methods.

It should be noted that while a three-piece blade is shown, a single-piece blade that is not adjustable in length may be used in its place.

The bottom edge of the blade 60 includes a front-facing scraper member 84 (note FIG. 1) and rear-facing cutter bar 86. The front scraper member 84 is designed to contact the ground and may be replaced once it has worn down. The rear-facing cutter bar 86 is similar to the scraper member and is designed to cut or scrape the surface of the ground when the plow blade is moved in a rearward direction. The scraper 84 and cutter 86 are advantageously used together when the operator wishes to scrape down packed or crusted snow by moving the blade back and fourth across said area.

Figure 6:
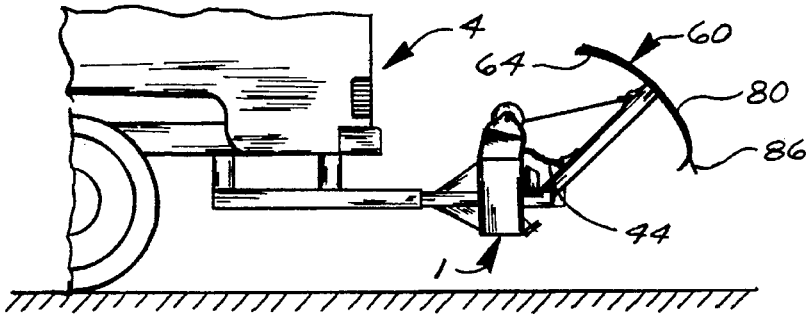
FIG. 6 is a generalized side view of the snowplow shown in FIG. 1 with the snowplow in a raised position.

In use, the plow apparatus is connected to the vehicle in the same manner as employed in attaching a trailer to the vehicle. During transport, the plow blade is normally maintained in a raised position (shown in FIG. 6) through action of the winch. Additionally, the raised position of the plow blade is maintained by the safety chain 44.

Once the operator is ready to use the plow, the blade is lowered using the winch. The vehicle is then initially moved forward or rearward at an angle to cause the blade to automatically pivot to one side. The vehicle then proceeds forwardly in a straight or curved path while the plow directs the snow to one side as it moves forwardly. The operator would continue making traverses of the area to be cleared until the required amount of snow has been removed. It should be noted that at any time, the operator of the vehicle can redirect the angle of the plow blade by merely sharply swinging the vehicle in an opposite direction than was used to initially set the plow blade or by moving the vehicle so that the bulk of the snow contacts the opposite end of the plow blade.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. A snowplow assembly adapted for removable securement to a vehicle, said assembly comprising;

a support fixture;

a plow blade adapted for plowing snow when moved in a predetermined direction;

a first attachment means connected to the support fixture and adapted for attachment to an end of a vehicle; and a second attachment means connected to the support fixture, and wherein said second attachment means is also connected to the plow blade and includes a pivot assembly that allows the plow blade to freely pivot in a horizontal plane at all times and wherein the pivot assembly of the second attachment means is in the form of at least one elongated member that may freely slide within a complementary slot.

2. The snowplow assembly of claim 1 wherein the first attachment means includes a portion adapted for attachment to a trailer hitch located on the rear of a vehicle.

3. The snowplow of claim 1 wherein said support fixture includes a first portion, a second portion and a pivot assembly that pivotally connects said first and second portions and wherein said first portion includes said first attachment means and second portion includes said second attachment means.

4. A snowplow assembly adapted for removable securement to the rear of a vehicle, said snow plow assembly comprising:

a central member having a front portion, a rear portion and a pivot means connecting said front and rear portions whereby said pivot means enables said rear portion to move in a vertical direction relative to the front portion;

a connecting means located at one end of the central member and adapted for securement to a receiving means located on the rear of a vehicle;

a winch means attached to said central member in a manner wherein operation of said winch means causes the rear portion of the central member to pivot relative to the front portion; and a plow blade adapted for plowing snow and attached by a pivot means to an extreme rear end portion of the rear portion of the central member, said pivot means allowing the plow blade to automatically pivot in response to unequal forces applied along the length of the plow blade.

5. The snowplow assembly of claim 4 wherein the pivot means that attaches the plow blade to the rear portion of the central member comprises a first portion and a second portion and wherein said first portion includes a pin means and wherein said second portion includes a slot means that receives the pin means of the first portion and wherein pivotal movement of the plow blade relative to the rear portion of the central member is accomplished through a sliding movement of the pin means within the slot means.

6. The snowplow assembly of claim 4 wherein the pivot means that attaches the plow blade to the rear portion of the central member is a free pivot that is designed to allow free pivoting of the plow blade at all times.

7. The snowplow assembly of claim 4 wherein the plow blade includes at least one removable end portion that is connected to a primary portion of the plow blade by a releasable locking means.

8. The snowplow assembly of claim 4 wherein the plow blade comprises first and second end portions that are releasably connected to opposite end portions of a center portion of the plow blade.

9. The snowplow assembly of claim 4 further comprising a first limit stop means that limits upward pivotal movement of the rear portion of the central member to a predetermined amount.

10. The snowplow assembly of claim 9 further comprising a second limit stop means that limits downward pivotal movement of the rear portion of the central member to a predetermined amount.

11. The snowplow assembly of claim 4 wherein the winch means is located on one of the front or rear portions of the central member and includes a strap that extends to a securement means located on the other of the front or rear portions of the central member.

12. The snowplow assembly of claim 11 wherein said strap extends in a straight line from the winch means to the securement means.

13. The snowplow assembly of claim 4 further comprising a cutter bar located on a bottom portion of the plow blade and wherein said plow blade includes an arcuate front surface and wherein the cutter blade extends outwardly from a rear surface of the plow blade.

14. The snowplow of claim 4 wherein the connecting means includes a tongue portion and wherein the receiving means located on the rear of said vehicle is in the form of a receiver-type trailer hitch and wherein said tongue portion is adapted to be received within and secured to said hitch.

* * * * *